United States Patent [19]

Robins et al.

[11] Patent Number: 5,009,163

[45] Date of Patent: Apr. 23, 1991

[54] NON-ELECTRIC SIGNAL TRANSMISSION DEVICE CONNECTION, METHOD AND APPARATUS THEREFOR

[75] Inventors: Kendall H. Robins, Bloomfield; Dennis K. Austin; Richard W. Spraggs, both of Simsbury, all of Conn.

[73] Assignee: The Ensign-Bickford Company, Simsbury, Conn.

[21] Appl. No.: 511,077

[22] Filed: Apr. 19, 1990

[51] Int. Cl.[5] ..... F42B 3/00; C06C 5/04

[52] U.S. Cl. ..... 102/301; 102/275.5; 102/275.7; 102/275.12; 102/313

[58] Field of Search ..... 102/275.7, 275.5, 275.1, 102/275.2, 275.3, 275.8, 275.12, 301, 313

[56] References Cited

U.S. PATENT DOCUMENTS

| | | | |
|---|---|---|---|
| 1,645,379 | 10/1927 | Fletcher et al. | 102/275.5 |
| 2,388,310 | 11/1945 | Curtiss | 102/275.12 |
| 2,535,518 | 12/1950 | Rich | 102/275.7 |
| 4,206,706 | 6/1980 | Steele | 102/275.7 |
| 4,699,059 | 10/1987 | Kelly et al. | 102/275.7 |
| 4,757,764 | 7/1988 | Thureson et al. | 102/275.8 |
| 4,771,694 | 9/1988 | Bartholomew et al. | 102/275.7 |

*Primary Examiner*—David H. Brown

*Attorney, Agent, or Firm*—Hayes & Reinsmith

[57] ABSTRACT

A connection between the ends of two discrete signal transmission devices allows signal propagation between the ends of the devices. The ends of the devices are axially aligned at a close distance from one another within an alignment sleeve. A length of heat-shrink tubing having a sealant on its inner surfaces is placed over the alignment sleeve and the ends of the devices. The tubing is heated and provides axially compressive and radially compressive forces on the alignment sleeve and device ends thereby providing a high tensile strength connection between the device ends.

14 Claims, 2 Drawing Sheets

NON-ELECTRIC SIGNAL TRANSMISSION DEVICE CONNECTION, METHOD AND APPARATUS THEREFOR

TECHNICAL FIELD

The present invention relates to non-electric signal transmission devices, and more particularly to a blasting initiation system using an improved connection for the ends of two or more non-electric signal transmission devices.

BACKGROUND OF THE INVENTION

In blasting operations, such as quarry blasting or mining operations, a plurality of small diameter bore holes are typically drilled in a predetermined pattern to effect a desired fragmentation pattern. Each bore hole in the pattern contains a detonating device for detonating a column of a bulk explosive composition. Each detonating device is interconnected to an initiation system by a signal transmission device for initiating the explosives.

It is desirable that the initiation system used to initiate the bore hole detonators be simple, quick and safe to set up and operate. It is also desirable that, during initiation of a bore hole detonator, the signal transmission device used to transmit the initiation signal not disturb the column of bulk explosive in any individual bore hole so as to cause premature explosive ignition or other unwanted disturbances. After the blasting initiation sequence is completed, it is desirable that any remaining initiation system debris be consumed during the blasting sequence to minimize removal problems.

There are a number of signal transmission devices available for use in an initiation system which posses some of the desirable qualities described herein before including both detonating cord and shock tube; however, no signal transmission device alone possess all of the aforementioned desirable qualities.

The term detonating cord includes a flexible cord made of various combinations of textile and plastic wrappings and containing a high velocity explosive, such as PETN, in the core. The wrapping material provides the cord's tensile strength and water resistence, and is consumed during signal propagation (detonation of the cord). A problem with detonating cord initiation of a bore hole detonator is that the detonation of the cord during signal propagation may produce unwanted disturbances of the column of explosive in the bore hole.

The shock tube may be of the type disclosed in U.S. Pat. No. 3,590,739, sold under the trademark "Nonel". As used herein, the term shock tube refers to any detonating or deflagrating transmission device including a flexible hollow tube which can carry a signal along its interior, which signal does not destroy the tube. A problem with an initiation system using only shock tube initiation of a bore hole detonator is that the shock tube above the surface of the bore hole explosive is not consumed during the blasting sequence, and therefor must often be removed from the production of the blast, such a debris removal problem being particularly important in, for example, salt mining.

It is therefor a primary object of the invention to provide an improved signal transmission device for use in a blasting initiation system which device does not disturb a column of explosive during signal transmission past the column of explosive to the bottom of the bore hole and which device is completely consumed after completion of a blasting sequence; it is another object of the invention to provide a pre-assembled connection between discrete lengths of signal transmission devices for reliable signal propagation between the discrete lengths of transmission devices; it is a further object of the invention to provide a low cost, reliable and high tensile strength connection between discrete length of transmission devices; it is another object of the invention to provide a connection between discrete lenghts of transmission devices which is resistant to penetration by environmental contaminants; it is a still further object of the invention to provide a factory assembled connection between a detonating cord and a shock tube for reliable signal transmission therebetween.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

A signal transmission device constructed according to the present invention comprises, in its preferred embodiment, an end of one transmission device axially aligned with an end of another transmission device, the ends of the transmission devices being axially aligned and at a sufficiently close distance to ensure signal transmission therebetween and preferably being diverse types of transmission devices; the ends of the transmission devices are connected in a factory assembly process, and often with an explosive initiator, wherein a non-occlusion material coextensively covers the ends of the transmission devices to maintain the axial alignment and prevent the introduction of any contaminants between the device ends, a tubing covers the material and the transmission tubes adjacent to the material and provides laterally and axially compressive forces for holding the devices in the material in axial alignment at a close distance and for providing a high tensile strength connection between the devices.

In further accord with the invention, a sealant material may be provided on the internal surfaces of the tubing cover for providing a seal between the tubular cover and the transmission devices to seal against environmental contamination.

The present invention provides a high quality factory assembled connection between discrete lengths of signal transmission devices to ensure reliable signal propagation between the devices. The connection is of high tensile strength and resistant to environmental contamination. With the present invention, different types of transmission devices may be factory connected, such as shock tube and detonating cord, for providing a unique transmission device possessing the superior qualities of its component parts. The factory connection of the invention also provides the ability to specially prepare unique combinations of transmission devices to meet the needs of individual users.

PREFERRED EMBODIMENT OF THE INVENTION

The present invention is particularly well suited for factory connection of pre-determined discrete lengths of transmission devices. The connection is of high tensile strength and provides a seal against the introduction of environmental contaminents between the devices for reliable signal propagation therebetween. The term "signal" as used herein is intended to refer to both the detonating shock wave or deflagrating flame front which is transmitted along the interior of a transmission device by combustion of a reactive substance contained therein.

The present invention is particularly useful with an initation system used in blasting operations, and therefor, the invention is shown in the context of a blast site containing a plurality of bore holes spaced apart in a pre determined pattern.

Figure 1:
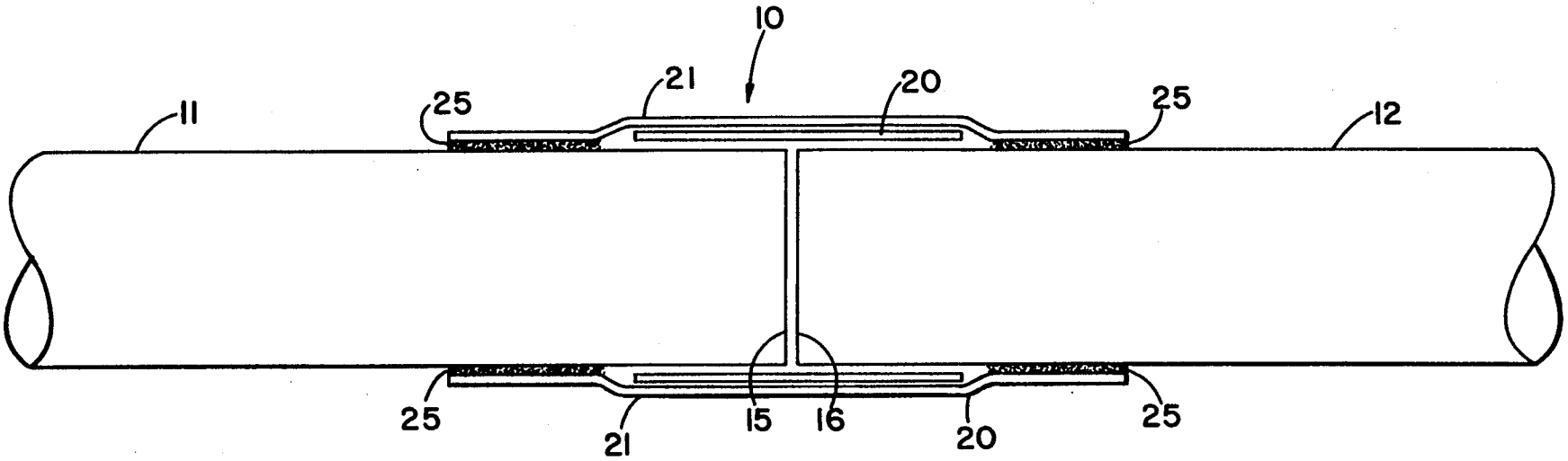
FIG. 1 is a perspective view of a connection between a detonating cord and a shock tube.

Referring to FIG. 1, a factory assembled connection between a pair of discrete transmission devices is generally indicated at numeral 10. Two discrete lengths of transmission device 11, 12, namely, shock tube and detonating cord, are provided, an end of each of the devices 15, 16 being placed in axial alignment within the connection 10 and in sufficiently close proximity to ensure that a signal will propagate between the ends.

The connection 10 comprises an alignment sleeve 20 and an outer tubing 21. The alignment sleeve 20 is applied after the transmission device ends 15, 16 are aligned, and maintains the alignment between the device ends during assembly of the connection. The alignment sleeve 20 also assists in preventing the introduction of environmental contamination between the device ends during intial assembly. The alignment sleeve 20 should be manufactured of a material that can be consumed by the explosion of an adjacent explosive column forming the bore hole charge. In the preferred embodiment, the alignment sleeve is made of a non-metalic material, such as tape. Other materials which also may be suitable for use as an alignment sleeve include plastic tube or heat-shrink tube, i.e. tubing which shrinks upon exposure to heat.

The outer tubing 21 provides lateral and axial compressive forces on the ends of transmission devices 15, 16 within the alignment sleeve 20 for securely holding the ends within the sleeve and with the desired relative position. The outer tubing preferably comprises heat shrink tubing.

The outer tubing 21 may further be provided with sealant material 25, such as heat sensitive adhesive on the inner surfaces of the tubing, for sealing and holding the tubing in position on the transmission devices. The sealant 25 will prevent the introduction of environmental contaminants within the connection and therefor ensure the reliable propagation of a signal between the ends of the transmission devices. The sealant 25 provides the further benefit of securely holding the transmission device ends 15, 16 in the outer tubing 21. The alignment sleeve 20 prevents the introduction of the sealant material between the transmission devices.

Figure 2:
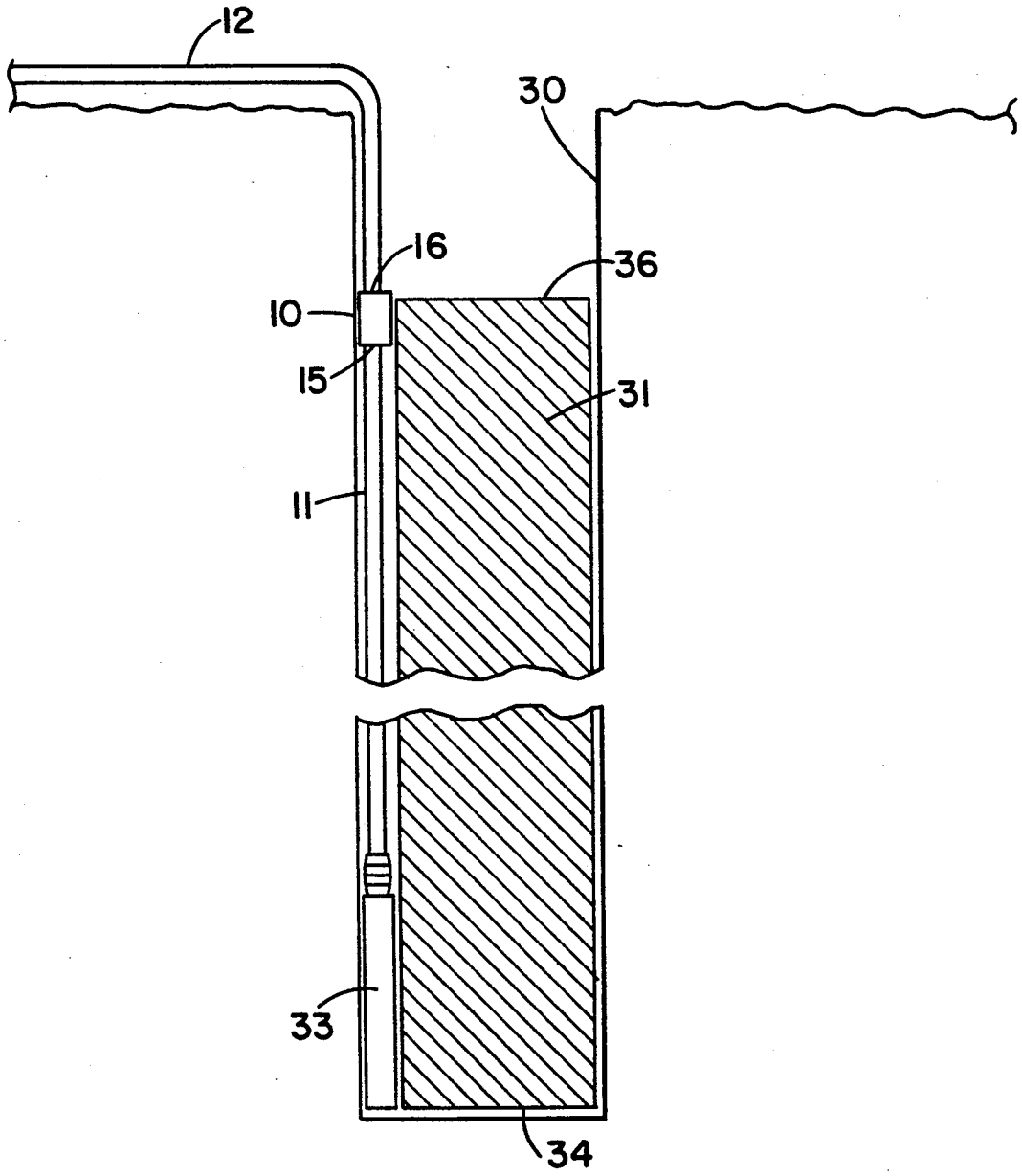
FIG. 2 is a perspective view of the connected transmission devices of FIG. 1 installed in a bore hole.

FIG. 2 is intended to illustrate an embodiment of a signal initiation system and transmission device falling within the scope of the invention without, however, limiting the system and/or tube to the same.

As illustrated in FIG. 2, an end 15 of a length of shock tube 11 is connected to an end 16 of a length of detonating cord 12 in accordance to the present invention. The shock tube 11 extends into a bore hole 30 containing a column of explosives 31, and is connected to a detonator 33 at the bottom of the column 34. A connection 10 between the shock tube 11 and the detonating cord 12 is located adjacent the top of the explosive column 36. The other end of the detonating cord is interconnected to the main blasting initiation system (not shown).

When it is desired to detonate the explosive column 31 in the bore hole 30, the detonating cord 12 is selectively initiated and thereby propagates a signal along its length into the connector 10. The detonating cord 12 is consumed while it propagates a signal, and leaves behind only a fine ash residue. In the connector 10 the signal is propagated between the end of the detonating cord 16 and the end of the shock tube 15, and the shock tube 11 then propagates the signal to the detonator 33, thereby detonating the explosive column 31 in the bore hole 30. During propagation of a signal by the shock tube 11, the signal is contained within the shock tube, and thereby does not disturb the explosive column 31. However, the shock tube 11 and the connection 10 are consumed during the explosion of the explosive column 31.

The factory connection of the present invention greatly simplifies the field assembly of an initiation system such as the initiation system described hereinbefore. The user merely selects from a variety of factory assembled transmission devices the assembly having the proper lengths of connected shock tube and detonating cord, the shock tube having a detonator already connected. Additionally, any combination of shock tube and detonating cord can be connected under factory conditions to meet the specifications of an end user.

The assembly of the connected transmission devices and the detonator under controlled factory conditions virtually eliminates the introduction of contamination in any of the connections, thereby improving the reliability of signal transmission and detonation. Additionally, the set up of the initiation system is greatly simplified because field connections are minimized.

Although the invention has been illustrated and described with respect to exemplary embodiments thereof, it should be understood by those skilled in the art that the foregoing and various other changes, omissions and additions may be made therein and thereto, without departing from the spirit and scope of the invention.

I claim:

1. A consumable, low-residue producing initiating system for detonating a column of explosive by the transmission of an initiating signal to a detonator adjacent to the bottom of the column comprising:

a length of detonating cord between an initiating point of the system and the top of the explosive column, said detonating cord being consumed during transmission of the initiation signal;

a length of shock tube between the explosive column top and the detonator, said shock tube being consumed by the detonation of the explosive column; and a connection between an end of said detonating cord and end of said shock tube at the explosive column top, said connection being of high tensile strength and having a tubing for holding said detonating cord and shock tube ends in axial alignment at a sufficiently close distance from one another for reliable signal transmission therebetween, said connection being consumed in response to detonation of the explosive column.

2. The system according to claim 1 wherein said tubing is a length of heat-shrink tubing, said tubing shrinking in response to exposure to heat and thereby applying axial and radial compressive force on said detonating cord and shock tube ends.

3. The system according to claim 1 further comprising a sealant disposed on the internal surfaces of said tubing, said sealant providing an environmental seal between said tubing and said detonating cord and between said tubing and said shock tube.

4. The system according to claim 3 wherein said sealant is heat curable adhesive.

5. The system according to claim 3 further comprising a sleeve disposed between said tubing and said detonating cord and shock tube ends, said sleeve preventing the introduction of said sealant between said shock tube and said detonating cord.

6. The system according to claim 5 wherein said sleeve is a length of tape.

7. A consumable, low residue producing blasting system for the detonation of an explosive column by the transmission of an initiation signal to a detonator adjacent to the bottom of the explosive column comprising:

a length of a detonating cord between an initiating point of the system and the top of the explosive column, said detonating cord being consumed in response to transmitting said initiation signal;

a length of shock tube between the top of the explosive column and the detonator, said shock tube being consumed in response to detonation of the explosive column.

means for axially aligning an end of said detonating cord and an end of said shock tube at the explosive column top, said means preventing the introduction of contamination between said ends, said means further maintaining the axial alignment between said ends at a sufficiently close distance from one another for reliable signal propagation therebetween;

a tubing surrounding said means for aligning, said tubing extending along a length of said shock tube and said detonating cord adjacent to said means for aligning, said tubing providing longitudinal and radial compressive forces for holding said ends within said means for aligning; and wherein said means for aligning and said tubing are consumed in response to detonating said explosive column.

8. Apparatus according to claim 7 further comprising a sealant disposed between said tubing and said detonating cord and between said tubing and said shock tube for providing a seal against the introduction of environmental contamination within said tubing.

9. Apparatus according to claim 7 wherein said means for aligning comprises a length of tape.

10. Apparatus according to claim 7 wherein said means for aligning comprises plastic tubing.

11. Apparatus according to claim 7 wherein said tubing comprises a length of heat-shrink tubing, said tubing decreasing in length and internal diameter upon exposure to heat.

12. The method of detonating an explosive column with a consumable, low-residue producing blasting system having a detonator adjacent to the bottom of the explosive column, the method comprising the steps of:

providing a length of detonating cord between an initiating point of the system and the top of the explosive column;

providing a length of shock tube between the explosive column top and the detonator;

providing a length of heat-shrinkable tubing;

inserting said detonating cord through said tubing;

axially aligning an end of said shock tube and an end of said detonating cord at the explosive column top at a sufficiently close distance from one another for reliable signal propagation therebetween;

sliding said tubing over said aligned ends; and heating said tubing, thereby shrinking said tubing for providing axial compressive and radial compressive forces on said ends.

13. The method of claim 12 further comprising the step of providing a sealant on the inner surfaces of said tubing.

14. The method of claim 13 further comprising the steps of:

providing a length of tape; and wrapping said tape around said aligned ends prior to sliding said tubing over said aligned ends.

* * * * *